US007037148B2

(12) United States Patent
Tsumiyama et al.

(10) Patent No.: US 7,037,148 B2
(45) Date of Patent: May 2, 2006

(54) THEFT PREVENTION METHOD AND APPARATUS OF PERSONAL WATERCRAFT

(75) Inventors: Yoshinori Tsumiyama, Miki (JP); Kenichi Nakagawa, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 2 days.

(21) Appl. No.: 10/800,325

(22) Filed: Mar. 11, 2004

(65) Prior Publication Data

US 2004/0198106 A1 Oct. 7, 2004

(30) Foreign Application Priority Data

Mar. 12, 2003 (JP) ..... 2003-066732

(51) Int. Cl.
*B63H 21/22* (2006.01)

(52) U.S. Cl. ..... 440/1; 180/287; 307/10.2; 307/10.3; 307/10.5

(58) Field of Classification Search ..... 440/1; 180/287; 307/10.2, 10.3, 10.4, 10.5

See application file for complete search history.

(56) References Cited

U.S. PATENT DOCUMENTS

| | | | | |
|---|---|---|---|---|
| 6,181,026 | B1 * | 1/2001 | Treharne et al. | 307/10.3 |
| 6,297,567 | B1 * | 10/2001 | Yano | 307/10.3 |
| 6,352,045 | B1 * | 3/2002 | Takashima | 114/55.5 |
| 2002/0151230 | A1 * | 10/2002 | Kanno | 440/84 |
| 2004/0051379 | A1 * | 3/2004 | Turner et al. | 307/10.2 |

FOREIGN PATENT DOCUMENTS

| | | |
|---|---|---|
| JP | 2001-028537 | 2/2001 |
| JP | 2002-225799 | 3/2002 |

* cited by examiner

*Primary Examiner*—Sherman Basinger
(74) *Attorney, Agent, or Firm*—Alleman Hall McCoy Russell & Tuttle LLP

(57) ABSTRACT

A theft prevention apparatus of a personal watercraft equipped with a main switch for opening/closing a main power-supply circuit including a starting circuit of an engine is provided. The apparatus inhibits the engine from starting when it detects the main switch being in an ON-state, no existence of a connection between an operating device of the main switch and the main switch, and a stopping of the engine. The apparatus prevents the engine from starting by inhibiting at least one of the starting circuits of the engine, an ignition circuit of the engine, and a fuel injection circuit of the engine from closing the circuit(s).

10 Claims, 10 Drawing Sheets

THEFT PREVENTION METHOD AND APPARATUS OF PERSONAL WATERCRAFT

TECHNICAL FIELD

The present invention relates to a personal watercraft equipped with a main switch for opening/closing a main power-supply circuit, and especially to a theft prevention method and apparatus thereof.

BACKGROUND OF THE INVENTION

Generally, a personal watercraft (PWC) is configured such that power is supplied to a starting circuit to start an engine when a starter switch is operated while a main power supply is in an ON-state. On the other hand, a circuit accompanying the main power supply (for example, an ignition circuit of the engine) is cut off to stop the engine when a kill switch, which is usually in an ON-position, is operated.

Among those personal watercraft with the above configuration, some watercraft are provided with a key-operated main switch, similar to an automobile, as disclosed in Japanese Patent Publication No. 2002-225799. This type of switch is electrically connected in series with the kill switch for stopping the engine and a main power-supply circuit, or is electrically connected in series with the kill switch and the main power-supply circuit through a relay. When a key is inserted into the main switch and turned to an ON-position, the main power supply moves to an ON-state and, then, starting of the engine can be readily achieved. On the other hand, by turning the key inserted in the main switch to an OFF-position, the main power supply moves to an OFF-state and, then, the engine stops if the engine has been running.

As for the personal watercraft, the main switch is constructed such that the key can be removed from the main switch even when it is in the ON-position, since sea water, sand, etc. tend to penetrate into the main switch if the key remains inserted in the main switch. Thus, during operation, an operator in many cases may remove the key from the main switch while the main switch is in the ON-position after the engine is started, and may put the key into an equipment storage fixture of the personal watercraft, such as a compartment, or may put the key into a pocket of a life jacket to carry the key around.

On the other hand, the kill switch (also referred to as a stop switch) for stopping the engine is maintained in the ON-position by keeping one end of a tether cord (also referred to as a lanyard) attached thereto. The other end of the tether cord is secured to an operator. Thus, if the operator falls off of the watercraft during cruising and separates from the watercraft, the tether cord is detached from the kill switch and, then, the kill switch turns to the OFF-position and the engine stops. The kill switch can also be operated to the OFF-position while the tether cord is attached.

However, when mooring, landing, or otherwise stopping a conventional personal watercraft equipped with a main switch as mentioned above, it is often troublesome for the operator to take out the key, since it is often stored away. Instead of using the key to turn off the engine, the operator may either stop the engine with the kill switch and remove the tether cord from the kill switch, or simply remove the tether cord from the kill switch, in order to stop the engine. For this reason, the operator may dismount and leave the watercraft with the main switch in the ON-position.

In such a case, the kill switch cannot be turned into the ON-position to start the engine without the tether cord.

However, because the tether cord is simple in construction, it may be possible for a third party to use another tether cord, such as a tether cord produced by another watercraft manufacturer, to turn the kill switch to the ON-position and start the engine. As a result, there exists a chance of theft of the watercraft.

BRIEF SUMMARY OF THE INVENTION

The present invention addresses the above-mentioned conditions, and one aspect of the present invention is to provide a theft prevention method and apparatus of a personal watercraft which can prevent an engine from starting without a main switch key for the watercraft when an operator is separated from the watercraft and the main switch is left in an ON-position, without requiring any particular operation of the operator.

According to one aspect of the present invention, a theft prevention apparatus of a personal watercraft is equipped with a main switch for opening/closing a main power-supply circuit, including a starting circuit of an engine. The theft prevention apparatus typically comprises a main switch ON-state detector for detecting the main switch being in an ON-state, an operating device of the main switch, an operating device detector for detecting an existence of a connection between the operating device and an operating device receptor, an engine stop detector for detecting an engine stop, and an engine start inhibitor for inhibiting the engine from starting. Typically the engine start inhibitor is configured to inhibit starting of the engine when the main switch ON-state detector detects that the main switch is in the ON-state, the operating device detector detects that there is no connection between the operating device and the main switch, and the engine stop detector detects an engine stop.

The theft prevention apparatus is configured so as to automatically inhibit the engine from starting when the following three conditions are all met: (1) the main switch is in the ON-state, (2) no connection exists between the operating device for the main switch and the main switch, and (3) the engine is stopped. Thus, theft of the personal watercraft can be effectively deterred even if the operator leaves the personal watercraft with the main switch in the ON-state.

In the above-mentioned state in which the engine is inhibited from starting, the engine cannot be started even if a starter switch for closing the starting circuit of the engine is in the ON-position. In addition, the engine cannot be started even if the starter switch is in the ON-position after attaching the tether cord to the kill switch. Therefore, no unauthorized person can use the personal watercraft by merely applying a tether cord of another manufacturer or of another watercraft.

According to one aspect of the invention, the above-mentioned operating device receptor may be formed integrally with the main switch. The main switch may be a key-operable main switch similar to a kind of so-called main switch used in automobiles, and the operating device for the main switch may be a key. Typically, the key-operated main switch is configured so that it can be in an ON-state when turned to one direction with a key of the main switch inserted therein and can be in an OFF-state when turned to another direction. It is preferable that the main switch is a type such that the key can be removed from the main switch in the ON-state.

According to another aspect of the invention, if the personal watercraft is not equipped with a key-operated main switch as described above, the main switch alternatively may be a kill switch for stopping the engine (or for opening the main power-supply circuit) with/without a tether cord. It will also be appreciated that the main switch may be virtually any other kind of switch that is suitable for opening/closing the main power-supply circuit of the personal watercraft, which is connected (or may be connected through a relay) in series with at least one of the starting circuit of the engine, an ignition circuit of the engine, and a fuel injection circuit of the engine. For example, the operating device may be an IC transmitter for storing information related to an operator of the personal watercraft and capable of performing a radio transmission of the information, and the operating device receptor may be an IC receiver attached to a body of the personal watercraft and configured to perform a radio reception of the information transmitted from the IC transmitter. Further, the main switch ON-state detector, the engine stop detector, the operating device detector, and the engine start inhibitor may be included in an electronic control unit connected with the IC receiver through a signal line, and configured to send an instruction to the main switch to open/close the main power-supply circuit. Further, the electronic control unit may be configured to inhibit the engine from starting when the main switch is detected as being in the ON-state by the electronic control unit, when no connection is detected between the operating device and the operating device receptor by the operating device detector, and when an engine stop is detected by the electronic control unit.

It is preferable that the engine stop detector be configured so as to detect at least one of a removal operation of the tether cord from the kill switch, an OFF-operation of the kill switch, and a zero engine speed. In order to detect the zero engine speed (which includes zero and approximately zero engine speed), it is possible to use an engine speed sensor with which the personal watercraft is typically equipped.

The main switch ON-state detector should be configured so as to be able to detect at least the main switch being in the ON-state. For example, the main switch ON-state detector may be configured so as to detect at least one of a closed state of the ignition circuit of the engine and the fuel injection circuit of the engine. The main switch ON-state detector may also be configured to detect the ON-state of the main switch.

The engine start inhibitor is typically configured so as to inhibit the engine from starting. For example, the engine start inhibitor may be configured so as to inhibit at least one of the starting circuit of the engine, the ignition circuit of the engine, and the fuel injection circuit of the engine, from closing the circuit(s).

Further, the theft prevention apparatus may not be configured so as to inhibit the engine from starting "immediately" after the following three conditions are all met; (1) the main switch is in the ON-state, (2) no connection exists between the operating device and the operating device receptor, and (3) the engine is stopped. Instead, for example, the theft prevention apparatus may count or wait a predetermined time interval from the time point that the three conditions are all met and, if the preceding three conditions remain satisfied when the time count reaches the predetermined time interval, then the apparatus may inhibit the engine from starting after the predetermined time interval has elapsed. Thus, with this configuration, an operator can re-start the engine promptly even if the engine is unintentionally stopped.

Still further, the theft prevention apparatus may further comprise an alert indicator for alerting an operator of the personal watercraft when the following three conditions are all met; (1) the main switch is in the ON-state, (2) no connection exists between the operating device and the operating device receptor, and (3) the engine is stopped. With this configuration, the theft prevention apparatus can inform the operator that the theft prevention apparatus is going to shift into an operating state (which is a state of inhibiting the engine from starting) when the operator intentionally cuts the engine by, for example, operating the kill switch.

Preferably, the theft prevention apparatus is configured so as to be returned to a non-operating state from the operating state (i.e., Engine Start Inhibiting State) when turning the main switch back to the ON-state after once turning the main switch to the OFF-state. With this configuration, for the personal watercraft equipped with the key-operated main switch, the operating state of the theft prevention apparatus typically cannot be changed to the non-operating state without the key of the main switch and, thus, more reliable theft prevention for the personal watercraft can be possible.

The above and further objects and features of the present invention will more fully be apparent from the following detailed description with accompanying drawings.

DETAILED DESCRIPTION OF THE INVENTION

The present invention will now be described in detail referring to the accompanying drawings illustrating the embodiments thereof.

Embodiment 1

Figure 1:
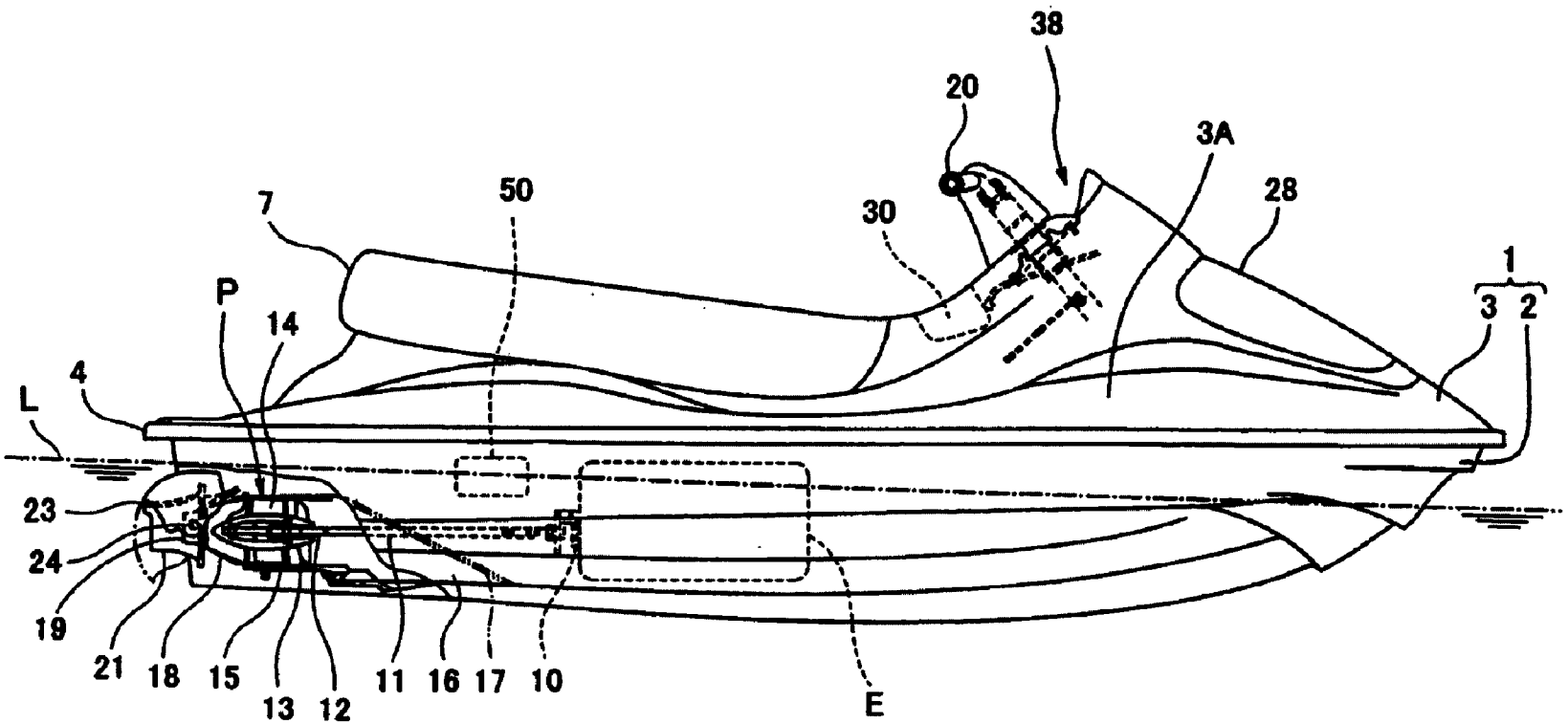
FIG. 1 is a side view showing an entire personal watercraft of the present invention.
Figure 2:
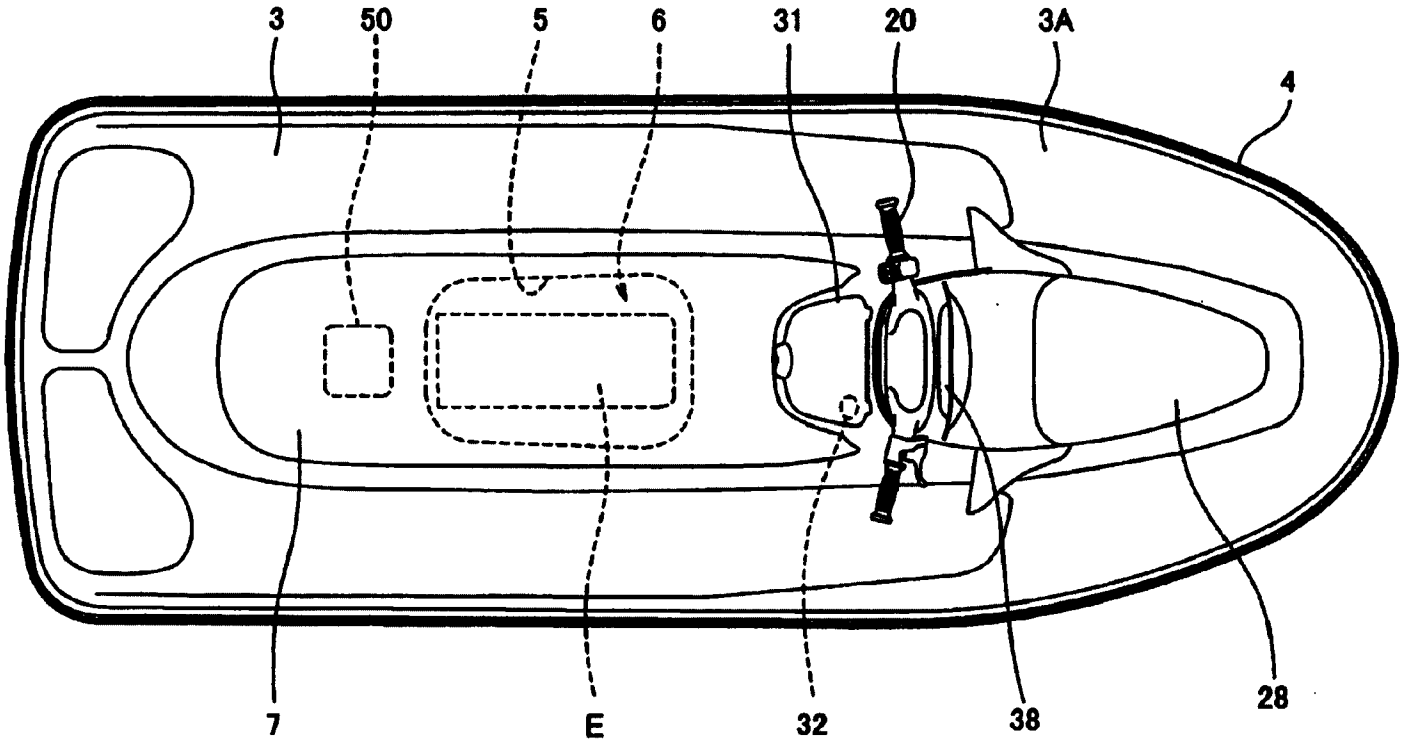
FIG. 2 is a plan view of the entire personal watercraft shown in FIG. 1.

FIG. 1 is a side view showing an entire personal watercraft of according to a first embodiment of the present invention, and FIG. 2 is a plan view of the personal watercraft shown in FIG. 1. In FIGS. 1 and 2, a body 1 of the personal watercraft comprises a hull 2 and a deck 3 covering the hull 2 from above. A line at which the hull 2 and the deck 3 are connected over the entire perimeter thereof is called a gunnel line 4. In this embodiment, the gunnel line 4 is located above a waterline L of the personal watercraft floating in a stationary condition in water.

As shown in FIG. 2, an opening 5 of a substantially rectangular shape extending in the longitudinal direction of the watercraft is formed slightly rearward of the middle section of the deck 3. The opening 5 is covered from above by a seat 7 on which an operator straddles. An engine E is provided in a space (usually referred to as "an engine room") 6 surrounded by the hull 2 and the deck 3 below the seat 7.

As shown in FIG. 1, a crankshaft 10 of the engine E extends rearward, and a rear end portion of the crankshaft 10 is rotatably coupled integrally with a pump shaft 12 of a water jet pump P through a propeller shaft 11. An impeller 13 is attached on the pump shaft 12 of the water jet pump P. The impeller 13 is covered with a cylindrical pump casing 15 on the outer periphery thereof.

A water intake 16 is provided on the bottom of the hull 2. Water is sucked from the water intake 16 and fed to the water jet pump P through a water intake passage 17. The water jet pump P pressurizes and accelerates the water by rotation of the impeller 13. The pressurized and accelerated water is discharged through a pump nozzle 18 having a cross-sectional area of water flow gradually reduced rearward, and from an outlet port 19 provided on the rear end of the pump nozzle 18, thereby obtaining thrust. In FIG. 1, a reference numeral 14 denotes fairing vanes for fairing water flow behind the impeller 13.

As shown in FIGS. 1, 2, reference numeral 20 denotes a bar-type steering handle. The handle 20 operates in association with a steering nozzle 21 swingable around a swing shaft (not shown) to the right or to the left behind the pump nozzle 18. When the operator rotates the handle 20 clockwise or counterclockwise, the steering nozzle 21 is swung toward the opposite direction so that the watercraft can be correspondingly turned to any desired direction.

As shown in FIG. 1, a bowl-shaped reverse deflector 23 is provided above the rear section of the steering nozzle 21 such that it can swing downward around a horizontally mounted swinging shaft 24. The deflector 23 is swung downward to a lower position behind the steering nozzle 21 to deflect the ejected water from the steering nozzle 21 forward and, as the resulting reaction, the personal watercraft moves rearward.

Figure 3:
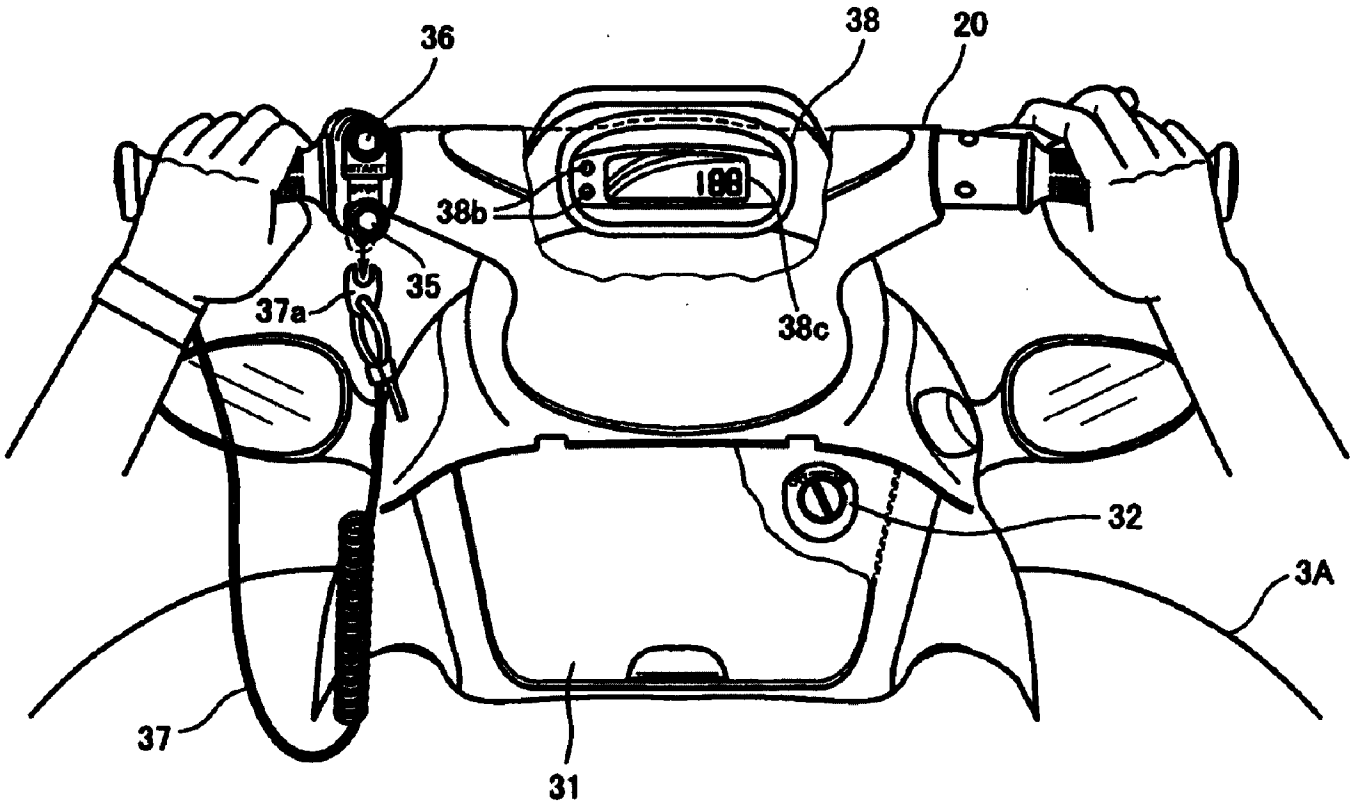
FIG. 3 is a partially schematic rider-perspective view showing in detail a steering handle area of the personal watercraft of FIG. 1, according to a first embodiment of the present invention.

In FIGS. 1 and 2, a multi-function panel 38 is provided on a front-side deck portion 3A in front of the handle 20 (also see FIG. 3). The multi-function panel 38 is constructed so as to include a display 38*c* configured to output various types of information, such as a speed of the watercraft and visual alert indicators. The multi-function panel further typically includes a user input device 38*b*, such as buttons 38*b* configured to receive settings information from a user, which is stored in a memory 50*a* (referring to FIG. 4).

On the front-side deck portion 3A in front of the multi-function panel 38, a front-side hatch cover 28 for covering a compartment (not shown) formed in the body of the watercraft is provided. The hatch cover 28 is rotatable around an axis in the right-and-left direction (not shown) at a front end thereof.

As shown in FIGS. 1 and 2, a glove box 30 of small capacity is provided in a position between the handle 20 and the seat 7. The glove box 30, as well as a main switch 32 (also see FIG. 3) adjacently provided, are covered by a glove box cover 31.

As shown in FIG. 3, a starter switch 36 is disposed on one side of the handle 10 (on the left-hand side in this embodiment) with a kill switch 35 below. The starter switch 36 is connected to an Electronic Control Unit (ECU) 50 (see also FIGS. 1, 2, and 4) with which the watercraft of this embodiment is equipped. Typically, the starter switch 36 is a button-type switch. When an operator pushes the starter switch 36 while the main power-supply circuit is closed to be in the ON-state, electric power is supplied to the starting motor M of the engine E (refer to FIG. 4) and, then the engine E starts. Typically, the kill switch 35 is a button-type switch that is similar to the above-mentioned starter switch. When the operator pushes the button-type switch, electric power being supplied to an igniting device and a fuel injection device (refer to FIG. 4) of the engine E is stopped and, then, the engine E stops. The kill switch 35 makes the starter switch 36 active (that is, to make the main power-supply circuit closed to be in the ON-state) when one end of the tether cord 37, which typically includes a clip 37*a*, is attached to the kill switch 35, and an operating device such as key 32*a* is inserted in the main switch 32 and, then, turned to the ON-position. Main switch 32 thus includes a key-receiving portion that functions as an operating device receptor, as it receives key 32*a*. When key 32*a* is inserted into the main switch, the key is said to be operatively coupled to the main switch, since insertion of the key into the switch enables the key to be rotated by a user, thereby actuating the main switch. The other end of the tether cord 37 is secured to the operator (typically, strapped around left wrist of the operator as shown in FIG. 3). In addition, the button-type kill switch 35 is constructed such that it can be turned into the OFF-position even if the clip 37*a* of the tether cord 37 is attached thereto.

Figure 4:
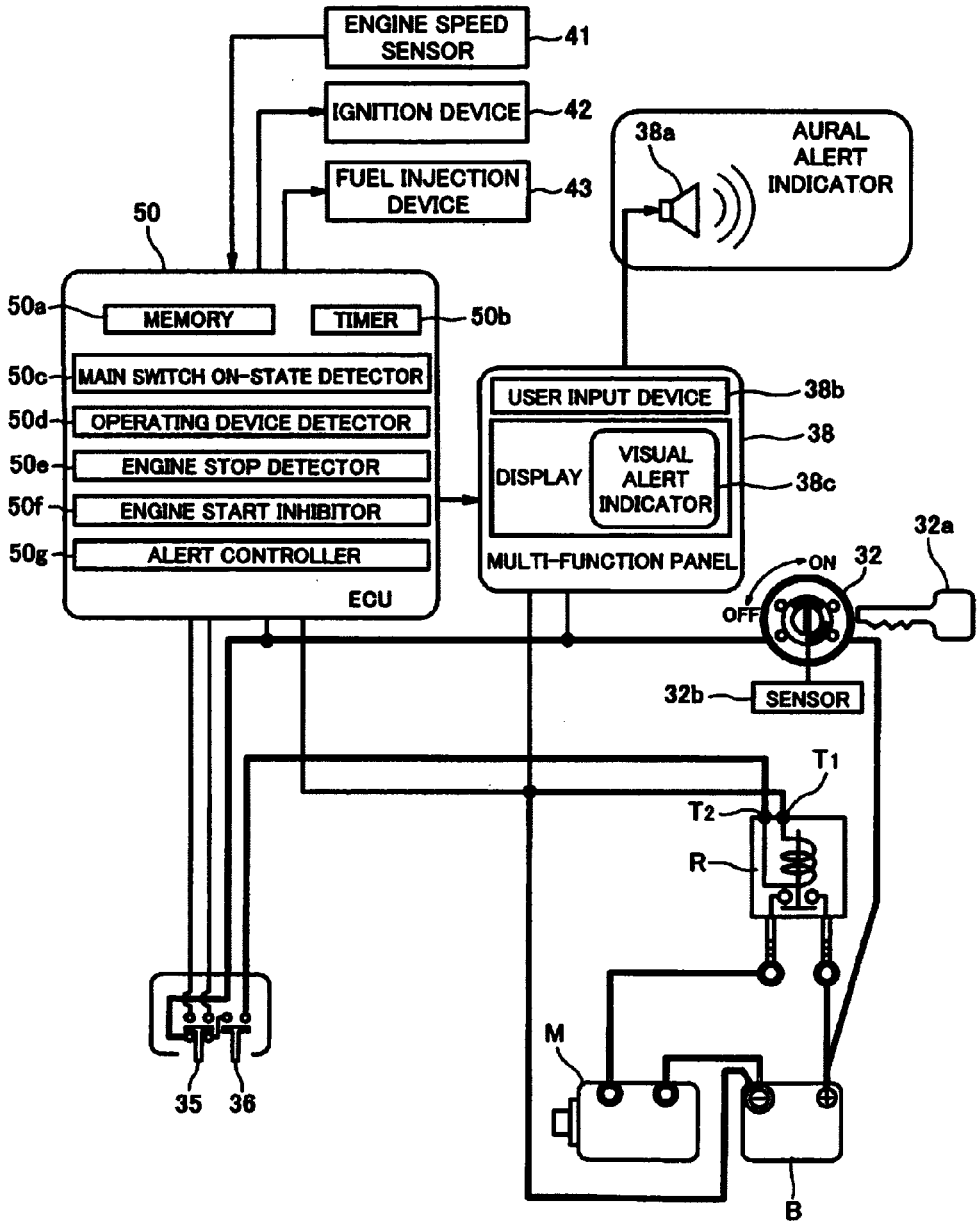
FIG. 4 is a schematic diagram showing a configuration of a theft prevention apparatus equipped in the personal watercraft according to the first embodiment of the present invention.

FIG. 4 is a block diagram showing a configuration of the theft prevention apparatus equipped in the personal watercraft according to an embodiment of the present invention. As shown in FIG. 4, in the theft prevention apparatus of this embodiment, a battery B and the starting motor M are connected with each other in series through a normally open contact of a starting relay R and, thus, constitute a drive circuit of the starting motor M.

One terminal $T_1$ on the side of the coil portion of the starting relay R is connected to a negative terminal of the battery B, and other terminal $T_2$ of on the side of the coil portion of the starting relay R is connected to one terminal of the starter switch 36, which comprises a normally open, push button switch and, further, another terminal of the starter switch 36 is connected to one terminal of the kill switch 35 which comprises a normally open, two-contact push button switch (but, closed while the clip 37*a* of the tether cord 37 is attached thereto), and another terminal of the kill switch 35 is connected to a positive terminal of the battery B through the main switch 32 and, thus, constitutes a starting circuit of the motor M shown by a thick line in FIG. 4. That is, the starting circuit includes the above-mentioned drive circuit and the relay operating circuit.

When the clip 37*a* of the tether cord 37 is attached to the kill switch 35, key 32*a*, which is an operating device of the main switch 32, is inserted into the main switch 32, which is in an OFF-position, and then turned clockwise to make the main switch 32 transition to the ON-position. Then, by pushing the starter switch 36, power is supplied to the starting circuit to excite the coil portion of the starting relay R and close the normally open contact of the starting relay R. Once closed, power is supplied to the drive circuit, causing the starting motor M to rotate and crank the engine E. In this condition, if the engine E is appropriately supplied with fuel and the fuel is ignited, the engine E starts.

The ECU 50 and the multi-function panel 38 are provided with one power line terminal thereof connected to the positive terminal of the battery B through the main switch 32 for opening/closing the main power-supply circuit, while other power line terminal thereof is connected to the negative terminal of the battery B, respectively. Therefore, power is supplied to the ECU 50 and the multi-function panel 38 while the main switch 32 is in the ON-position.

Moreover, the OFF-side contact of the kill switch 35 is connected to the ECU 50, and the engine stop detector of the ECU 50 can detect a stop operation of the engine E when a power supply occurs by closing the OFF-side contact of the kill switch 35.

On the other hand, the ECU 50 is connected with the multi-function panel 38, an engine speed sensor 41, an ignition device 42, and a fuel injection device 43, through signal lines.

The engine speed sensor 41 typically comprises a rotary encoder which is generally attached to an end of the crankshaft 10 (refer to FIG. 1) of the engine E or a flywheel (not illustrated), and provides a signal detected according to an engine speed of the engine E to the ECU 50.

The ignition device 42 comprises ignition coil(s) (not shown) of the engine E, and supplies power to corresponding spark plug(s) (not shown) according to an ignition signal from the ECU 50 to ignite fuel in an engine cylinder(s) of the engine E at an appropriate time. The fuel injection device 43 comprises injector(s) (not shown) of the engine E, and is configured such that it performs fuel injections with an appropriate fuel quantity and at an appropriate time by supplying power to corresponding injector(s) according to an injection signal from the ECU 50. Outputs of the ignition signal and the injection signal from the ECU 50 are started while synchronized with the above-mentioned cranking upon the pushing of the starter switch 36.

ECU 50 is configured to control each component of the watercraft based on detection signals from sensors (these sensors are usually equipped in the personal watercraft) provided in corresponding positions of the personal watercraft. The ECU 50 also controls the multi-function panel 38, the ignition device 42, and the fuel injection device 43 based on the detection signal from the engine speed sensor 41, or on the detection of a power-supply to the kill switch 35 by the engine-stop operation of the kill switch 35. The ECU includes a timer 50*b*, memory 50*a*, main switch ON-state detector 50*c*, operating device detector 50*d*, engine stop detector 50*e*, engine start inhibitor 50*f*, and alert controller 50*g* to assist in various control operations, as further explained with reference to the flowchart of FIG. 5.

Figure 5:
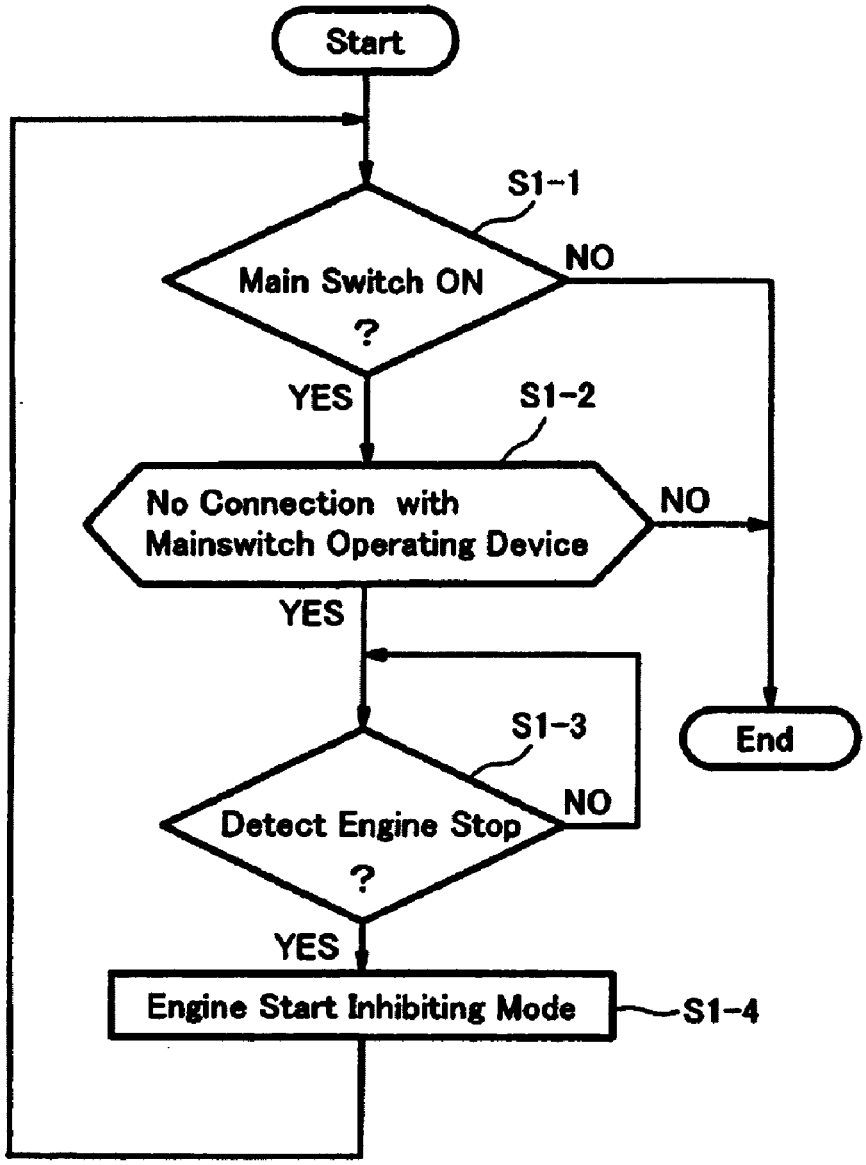
FIG. 5 is a flowchart showing processing procedures by an Electronic Control Unit (ECU) of the theft prevention apparatus shown in FIG. 4.

FIG. 5 is a flowchart which shows processing procedures of the ECU 50 in the theft prevention apparatus according to the first embodiment of the present invention. First, main switch ON-state detector 50*c* of ECU 50 determines whether or not the main switch 32 is in the ON-position (Step S1-1). Here, the determination of the main switch 32 being in the ON-position can be performed by detecting the existence of a power-supply to the main switch 32 (that is, the main switch 32 should be in the ON-position while the electric power is supplied from the battery B to the ECU 50). Alternatively, the main switch ON-state detector 50*c* may include a switch or sensor at the ON-position of the main switch 32, and may be configured to make the determination of the ON/OFF state of the main switch based on an existence of power supply to the switch or a detection signal from the sensor.

Since no power is supplied to the ECU 50 when the main switch 32 is not in the ON-position ("NO" at Step S1-1), the whole process is terminated (actually, the whole process may not be performed since there is no power supply to the ECU 50).

On the other hand, when the main switch 32 is detected in the ON-position ("YES" at Step S1-1), the operating device detector 50*d* of ECU 50 then determines whether or not a connection, i.e. an operative coupling, exists between the key, which is the operating device of the main switch 32, and operating device receptor of the main switch 32 (Step S1-2). The determination of the existence of the connection between the key and the main switch 32 can be achieved by, for example, providing a sensor 32*b* on the switch, the output of which is sent to the operating device detector 50*d*. Sensor 32*b* may be, for example, a micro-switch positioned in an insertion hole through which the main switch receives the key. A mechanical device for detecting a contact of the key and the micro-switch or an electric device for detecting an approach of the key and the micro-switch may also be provided. When the key is detected to be connected to the main switch 32 ("NO" at Step S1-2), the whole process is terminated. On the other hand, when the key is detected not to be connected to the main switch 32 ("YES" at Step S1-2), engine stop detector 50*e* of the ECU 50 then determines whether or not there is a detection of a stop of the engine E (Step S1-3). Engine stop detector 50*e* may be configured to detect the stop of the engine E based on, for example, a detection signal from the engine speed sensor 41 which indicates the engine speed has become approximately zero engine speed, or by a detection of the activation of kill switch 35. The activation of kill switch 35 may be detected by detecting an existence of power-supply to the kill switch 35 by the engine stop operation of the kill switch 35. When no engine stop is detected ("NO" at Step S1-3), the ECU 50 repeats Step S1-3.

On the other hand, when there is a detection of the stop of the engine E ("YES" at Step S1-3), the ECU 50 shifts to "an Engine Start Inhibiting Mode" (Step S1-4). In the Engine Start Inhibiting Mode, engine start inhibitor 50*f* of the ECU 50 is configured to inhibit the engine E from being started even if the starter switch 36 is operated, by preventing the output of an ignition signal to the ignition device 42, or by preventing the output of an injection signal to the fuel injection device 43, etc. In the Engine Start Inhibiting Mode, the engine start inhibitor 50*f* may also send a signal causing the multi-function panel 38 to display or otherwise output information which indicates that the ECU 50 is in "the Engine Start Inhibiting Mode."

Although not illustrated in FIG. 4, it is also possible to connect an appropriate contact with the drive circuit of the starting motor M in series and to make the engine stop inhibitor 50*f* of ECU 50 open this contact to prevent a power supply to the drive circuit.

The Engine Start Inhibiting Mode is continued by repeating the process from Step S1-1 to Step S1-4. When the main switch 32 is turned into the OFF-position in the middle of the Engine Start Inhibiting Mode, the power supply to the ECU 50 is stopped and the whole process is terminated. The engine start inhibitor 50*f* is configured so that the state where the starting of the engine E cannot be performed is cancelled by returning the main switch 32 to the ON-state after once changing the main switch 32 into the OFF-state.

It is also possible to provide an additional delay function as mentioned hereinafter and to configure the ECU 50 so that it may not shift to the Engine Start Inhibiting Mode immediately after detection the engine stop, in FIG. 5.

Figure 6:
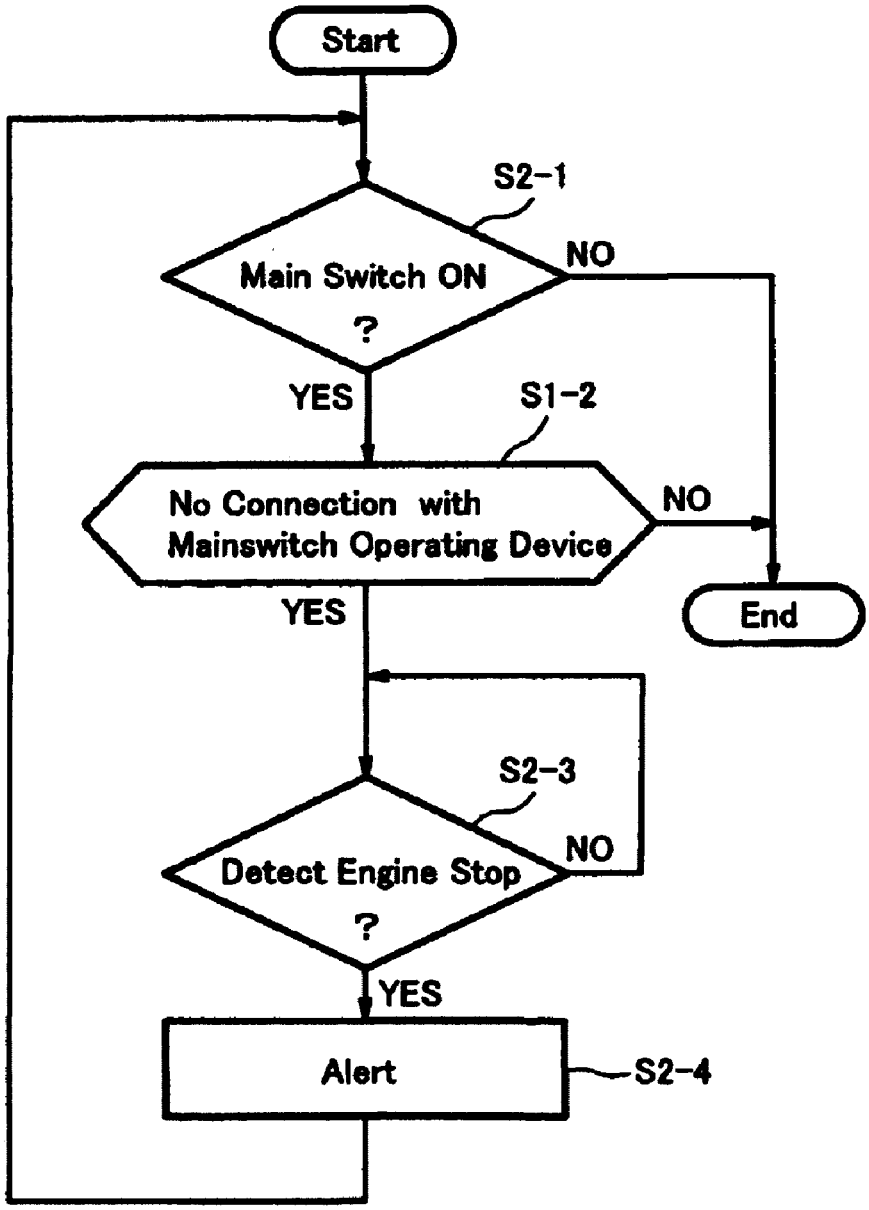
FIG. 6 is a flowchart showing another example of the processing procedures by the ECU of the theft prevention apparatus shown in FIG. 4.

Moreover, as shown in FIG. 6, the alert controller 50*g* of the ECU 50 may be configured so that it controls, for example, the multi-function panel 38 to output an alert indicator. The alert indicator may be output without shifting to the Engine Start Inhibiting Mode, even if the ECU 50 determines that the main switch 32 is in the ON-position, that the key which is the main switch operating device is not connected with the main switch, and that the engine E is stopped. The alert indicator may be an aural alert indicator such as a horn noise caused by supplying power to a horn 38*a* (refer to FIG. 4) with which the multi-function panel 38 typically is equipped or to which the multi-function panel 38 is connected. In addition or in the alternative, the alert indicator may be a visual alert indicator, such as blinking light emitting element(s) with which the multi-function panel 38 typically is equipped. By way of example, the display 38*b* may be of a luminescent type and all or a portion of the display may be configured to emit light as a visual alert indicator. The processes from Steps S2-1 to S2-4 in FIG. 6 are basically the same as the processes from Steps S1-1 to S1-4 in FIG. 5, except the shifting process to "the Engine Start Inhibiting Mode" (S1-4) is replaced with the shifting process to "an Alert Output Process" (S2-4). Therefore, explanations for other processes are omitted since they are identical.

Figure 7:
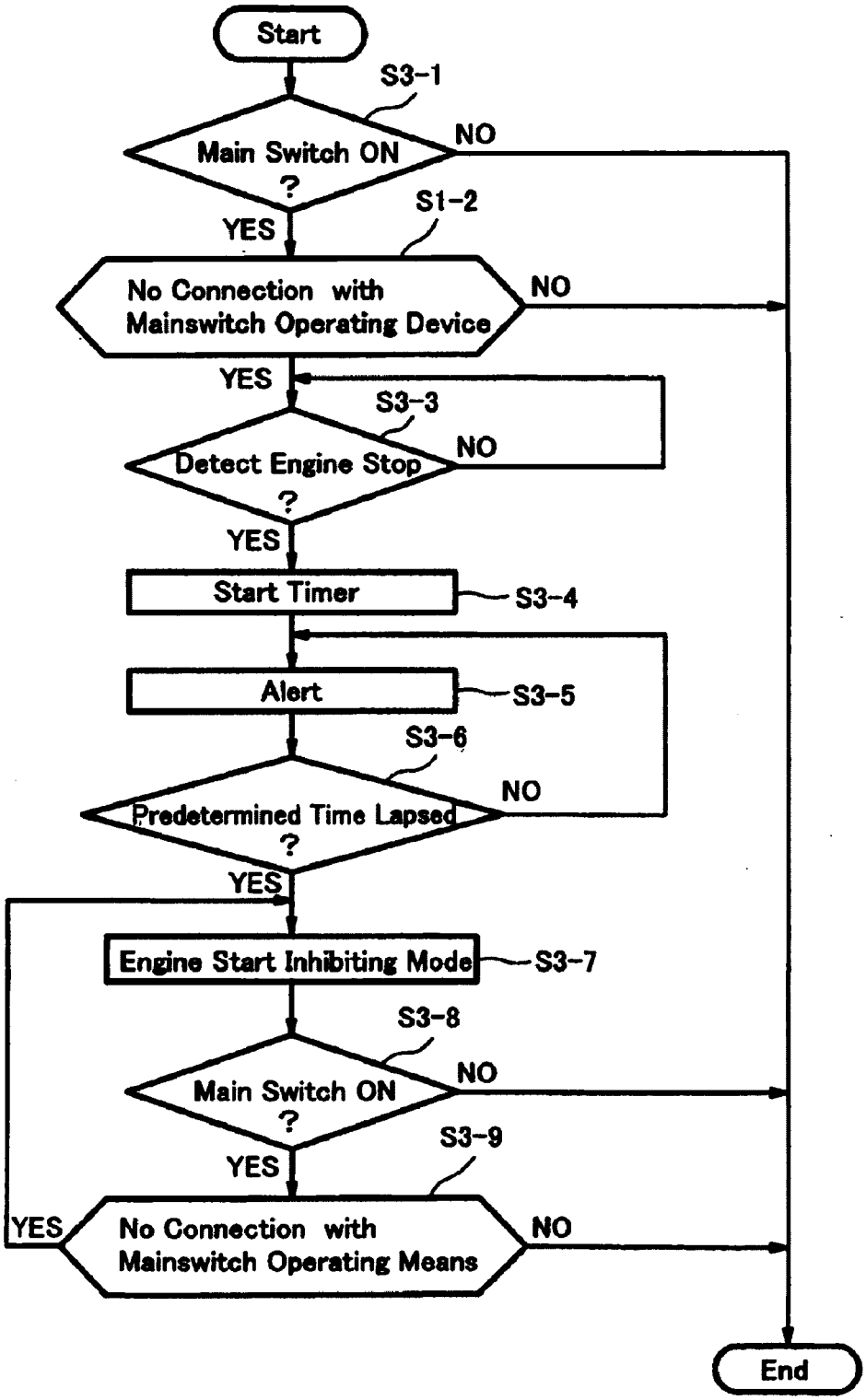
FIG. 7 is a flowchart showing still another example of the processing procedures by the ECU of the theft prevention apparatus shown in FIG. 4.

Moreover, as shown in FIG. 7, the ECU 50 performs the same processes as the above mentioned Steps S1-1 to S1-3 (Steps S3-1, S3-2, and S3-3) and, then, when a stop of the engine E is detected ("YES" at Step S3-3), the ECU 50 starts a time count by a built-in timer 50*b* (refer to FIG. 4) (Step S3-4), and outputs the same alert indicator as the above mentioned Step S2-4 (Step S3-5).

Next, the ECU 50 determines whether or not the time count of the timer 50*b* has lapsed a predetermined time interval (for example, several seconds) stored in the built-in memory 50*a* (referring to FIG. 4) (Step S3-6). When the predetermined time interval has not lapsed ("NO" at Step S3-6), the ECU 50 returns to the processes from Step S3-5, and continues the alert. On the other hand, when the predetermined time interval has lapsed ("YES" at Step S3-6), the ECU 50 shifts to "the Engine Start Inhibiting Mode" like the above-mentioned Step S1-4 (Step S3-7) and, again, the ECU 50 determines whether or not the main switch 32 is in the ON-position (Step S3-8).

When the main switch 32 is not in the ON-position ("NO" at Step S3-8), the whole process is terminated in the middle of the Engine Start Inhibiting Mode (actually, the whole process may not be performed since there is no longer a power supply to the ECU 50). On the other hand, when the main switch 32 is in the ON-position ("YES" at Step S3-8), the ECU 50 determines whether or not a connection exists between the key, which is the operating device of the main switch 32, and the main switch 32 (Step S3-9). When there is a connection of the key ("NO" at Step S3-9), the ECU 50 terminates the whole process. On the other hand, when there is no connection of the key ("YES" at Step S3-9), the ECU 50 repeats the processes from Step S3-7 to Step S3-9, and continues the Engine Start Inhibiting Mode.

With the configuration above, in case an operator tries to start the engine E, the transfer to the Engine Start Inhibiting Mode is delayed and, thus, starting of the engine E is possible by operating the starter switch 36 within the above mentioned predetermined time. Moreover, re-starting of the engine E is possible by turning the main switch 32 once into the OFF-position and, then, again turning the main switch back to the ON-position, even after shifting to the Engine Start Inhibiting Mode.

Embodiment 2

Figure 8:
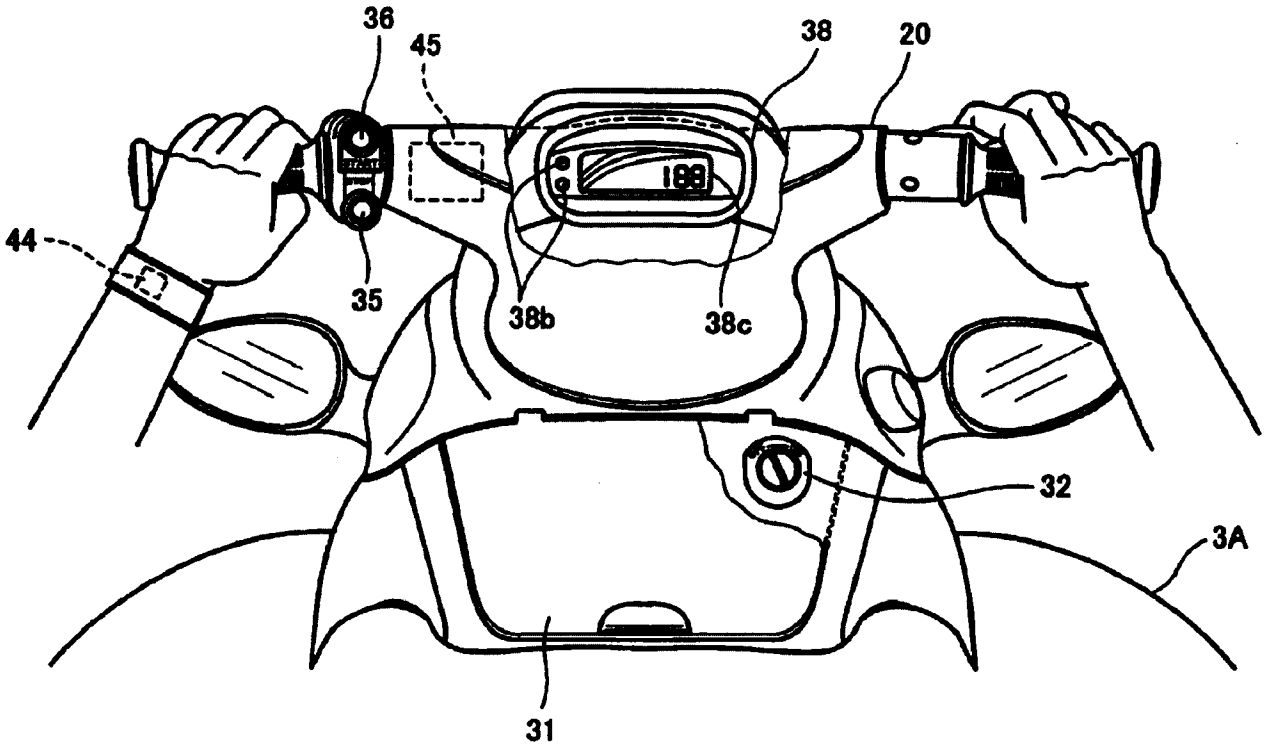
FIG. 8 is a partially schematic rider perspective view showing in detail a steering handle area of the personal watercraft of FIG. 1, according to a second embodiment of the present invention.

In the second embodiment, the theft prevention apparatus is configured such that it can prevent starting of the engine E similarly to the above-mentioned first embodiment. Specifically, in this embodiment, an operator wears an IC chip (IC transmitter) 44 as illustrated in FIG. 8, which stores a user identification code. The user identification code is a unique code given to individual operator. An IC reader (IC receiver) 45 is, for example, embedded in the steering handle 20 (see FIG. 8). The IC chip 44 and the IC reader 45 perform wireless-communication. The IC chip 44 transmits the user identification code stored therein, and the IC reader 45 receives the user identification code transmitted from the IC chip 44. IC reader 45 thus functions as an operating device receptor, receiving communication from the IC chip 44. When the IC chip 44 and IC reader 45 perform a valid exchange of the proper user identification code, they are said to be operatively coupled to each other, since various functions of the watercraft may be operable by the user once said exchange has occurred. For example, when operatively coupled, the IC chip may enable operation of the main switch 320 of the watercraft.

The IC chip 44 can be in various sizes. However, it should of such a size and weight that it does not become burdensome to the operator to wear. For example, it may be approximately 1 mm to rice-grain size. Moreover, as shown in FIG. 8, the IC chip 44 may be embedded in a wristband, wristwatch, or a tag to make it easier to wear by the operator.

Figure 9:
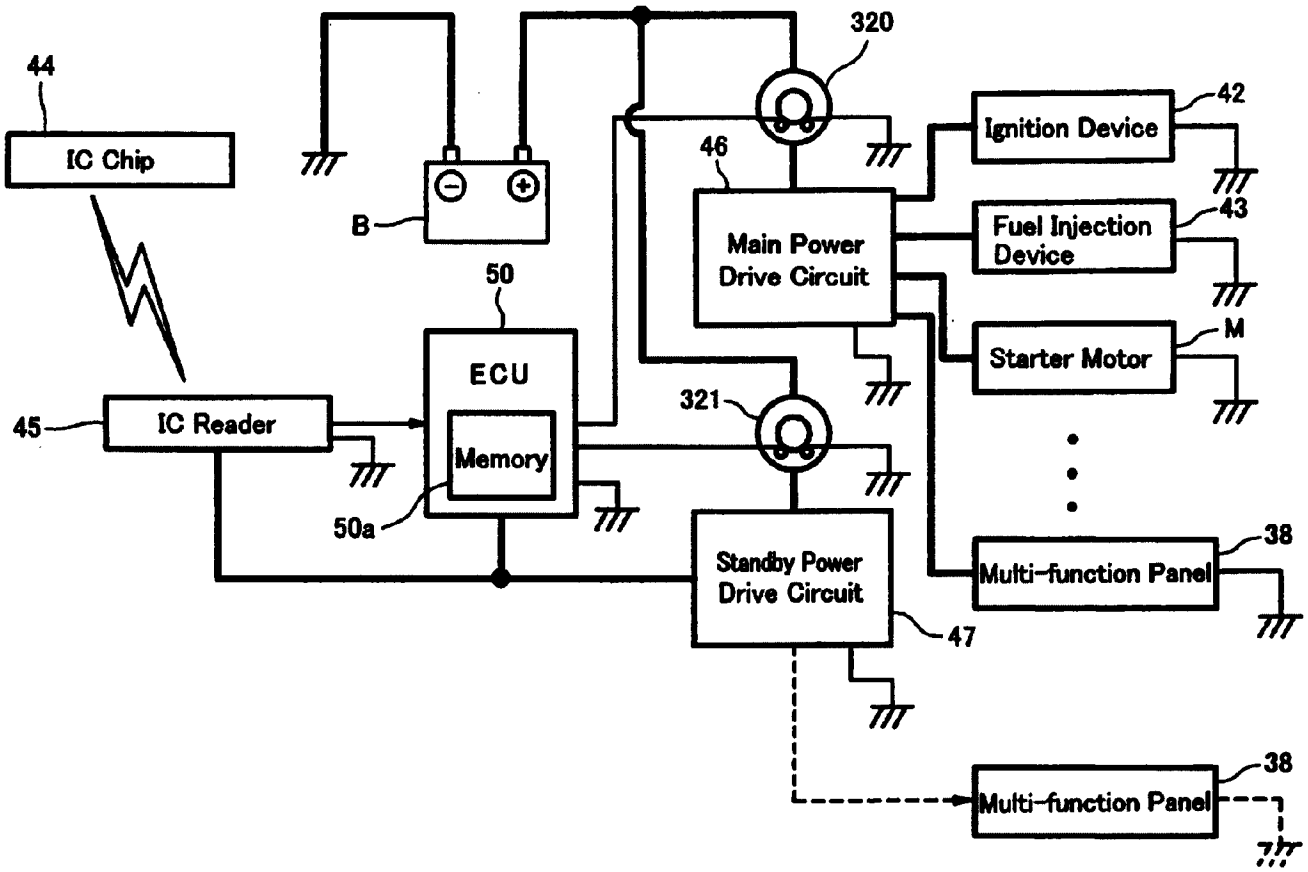
FIG. 9 is a schematic diagram showing a configuration of the theft prevention apparatus equipped in the personal watercraft according to the second embodiment of the present invention.

As shown in FIG. 9, the IC reader 45 is connected to the ECU 50, which includes a built-in memory 50*a*. The IC reader 45 gives the user identification code to the ECU 50 when the user identification code is received from the IC chip 44. Although not shown in FIG. 9, ECU 50 may also include various of the other modules 50*b*–50*g* described above.

The ECU 50 is connected with a main power-supply drive circuit 46, and performs an ON/OFF control, which is typically a closing/opening control of the main power-supply drive circuit 46. The IC chip 44 functions as an operating device that may enable the main switch 320 to be activated, as described below, and the IC reader 45 functions as an operating device receptor that establishes an operative coupling with the IC chip when the IC chip is in range. An operating device detector of ECU 50 is configured to receive signals from the IC reader 45 and determine whether a connection, i.e. operative coupling, between IC chip 44 and IC reader 45 has been established. In addition, the ECU 50 includes a main switch ON-state detector, an engine stop detector, and an engine start inhibitor, similar to those described above. The main power-supply drive circuit 46 is a power-supply circuit which supplies electric power to, for example, an ignition device 42, a fuel injection device 43, a starting motor M, and a multi-function panel 38, etc., that is, to components of the watercraft other than the ECU 50 and the IC reader 45. The main power-supply drive circuit 46 includes a main switch 320 whose ON/OFF control is carried out by the ECU 50. A standby power-supply drive circuit 47 supplies electric power to the ECU 50 and the IC reader 45.

Figure 10:
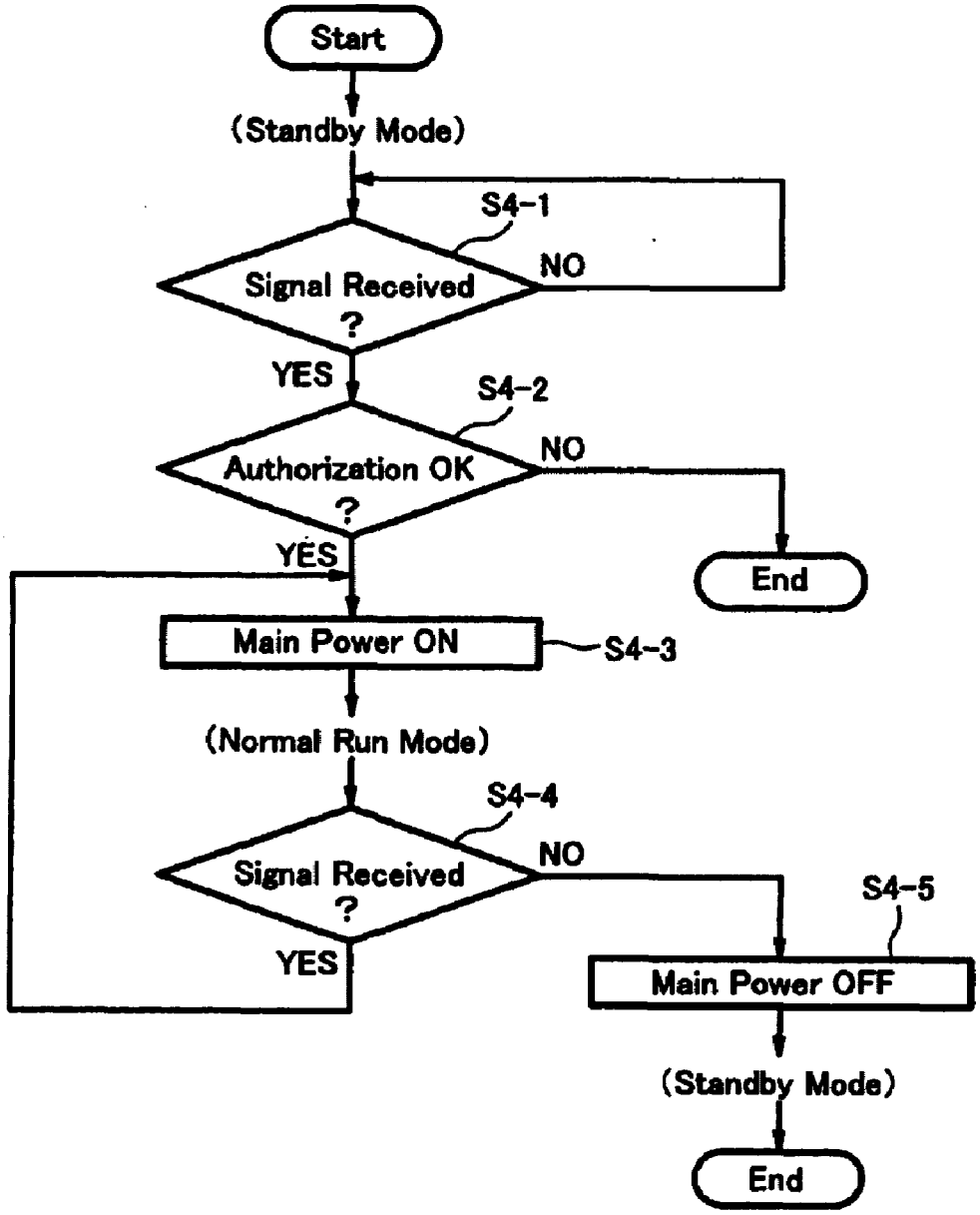
FIG. 10 is a flowchart showing processing procedures by an ECU of the theft prevention apparatus shown in FIG. 9.

In the theft prevention apparatus according to this second embodiment, the ECU 50 typically performs a control as shown in a flow chart of FIG. 10. First, the ECU 50 is in Standby Mode and awaits reception of a signal (that is, the user identification code) from the IC reader 45 (Step S4-1). When there is a reception of the user identification code ("YES" at Step S4-1), the ECU 50 certifies the user identification code by whether or not the user identification code received is identical to a user identification code stored in the memory 50*a* (Step S4-2).

When the user identification code is not valid ("NO" at Step S4-2), the ECU 50 terminates the whole process and continues to be in the Standby Mode. On the other hand, when the user identification code is valid ("YES" at Step S4-2), the ECU 50 closes the main power-supply drive circuit 46 to place it in the ON-state (Step S4-3), and shifts to a Normal Run Mode. In the Normal Run Mode, since power is supplied to the ignition device 42, the fuel injection device 43, and the starting motor M, etc., starting of the engine E is possible by operating the starter switch 36 (refer to FIG. 3) which opens/closes the relay circuit of the starting motor. M.

Again, the ECU 50 checks whether or not there is a reception of a signal (that is, the user identification code) by the IC reader 45 (Step S4-4). When the reception of the user identification code is continuing at this time ("YES" at Step S4-4), the ECU 50 returns to the processes from Step S4-3, and continues the Normal Run Mode. On the other hand, when there is no reception of the user identification code at the time of Step S4-4 ("NO" at Step S4-4), the ECU 50 opens the main power-supply drive circuit 46 (Step S4-5), and returns to the Standby Mode.

In the theft prevention apparatus according to this second embodiment, a main switch with a key that mechanically opens/closes the main power-supply drive circuit 46 is not typically provided. Rather, main switch 320 typically is configured to be controllable by the ECU 50 to automatically close the main power-supply drive circuit 46 to be in the ON-state only as an operator wearing an IC chip approaches the watercraft, and to automatically open the main power-supply drive circuit 46 as the operator separates from the watercraft. In addition, since the main power-supply drive circuit 46 is automatically opened to be in the OFF-state when the operator separates from the watercraft during a cruise, the engine E is stopped. Therefore, it is desirable to set the maximum distance over which the IC chip 44 and the IC reader 45 can communicate with this in mind. For example, it may be desirable to set the maximum communication distance to a limit of between approximately 1–3 meters, such that the engine shuts off before the watercraft travels a great distance away from an ejected rider in the water. Of course, other distances are also possible.

Electricity in the battery B is used when the standby power-supply drive circuit 47 is always closed to be in the ON-state. Therefore, it may be preferable to provide a switch 321 intermediate the battery B and the standby power-supply drive circuit 47 as shown in FIG. 9, for example, and to close the standby power-supply drive circuit 47 to be in the ON-state only when the switch 321 is in an ON-position. Furthermore, it may be preferable to connect the multi-function panel 38 with the standby power-supply drive circuit 47 in series as shown by a dashed line in FIG. 9. That way, the standby power-supply drive circuit 47 can keep the multi-function panel 38 to be in the ON-state and, thus, the multi-function panel 38 can output various information (for example, information indicating the ECU 50 is standing by) even when the ECU 50 is in standby mode.

The configuration and functions of the second embodiment are similar to the configuration and functions of the first embodiment unless otherwise explained above. Therefore, for simplification of explanation, the same reference numerals are given to the same portion/part as the first embodiment and, thus, the detailed explanations thereof are omitted.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within the metes and bounds of Claims, or equivalence of such metes and bounds thereof are therefore intended to be embraced by Claims.

What is claimed is:

1. A theft prevention method of a personal watercraft equipped with a key-operable main switch for opening/closing a main power-supply circuit including a starting circuit of an engine, the method comprising:

providing a main switch with a key-receiving portion, the main switch being switchable to an ON-state to activate the starting circuit of the engine when a key is inserted in the key-receiving portion, the key being removable from the key receiving portion while the main switch is in the ON-state;

detecting the main switch being in the ON-state;

detecting a stopping of the engine; and inhibiting the engine from starting, provided that the main switch is detected to be in the ON-state, the removable key is detected not to be operatively inserted into the main switch, and the engine is detected to be stopped.

2. A theft prevention apparatus of a personal watercraft equipped with a key-operable main switch for mechanically opening/closing a main power-supply circuit via the main switch including a starting circuit of an engine, comprising:

a main switch ON-state detector configured to detect that the main switch is in an ON-state;

a key configured to enable the main switch to be actuated;

a key detector configured to detect that the key is operatively inserted into a key-receiving portion of the main switch;

an engine stop detector configured to detect a stopping of the engine; and an engine start inhibitor configured to inhibit the engine from starting, provided that the main switch is detected in the ON-state by the main switch ON-state detector, the key is not detected by the key detector to be operatively inserted into the key-receiving portion of main switch, and the stopping of the engine is detected by the engine stop detector.

3. The theft prevention apparatus of claim 2, wherein the engine start inhibitor is configured so as to inhibit at least one of the starting circuits of the engine, an ignition circuit of the engine, and a fuel injection circuit of the engine from closing the circuit(s).

4. The theft prevention apparatus of claim 2, wherein the starting circuit of the engine is provided with the main switch, a kill switch with/without a tether cord for opening the main power-supply circuit, and a starter switch for closing the starting circuit of the engine.

5. The theft prevention apparatus of claim 4, wherein the engine stop detector is configured so as to detect at least one of a removal operation of the tether cord from the kill switch, an OFF-operation of the kill switch, and a zero engine speed.

6. The theft prevention apparatus of claim 2, wherein the engine start inhibitor includes a timer which starts a time count when the main switch ON-state detector detects the main switch being in the ON-state, the key detector detects no operative insertion of the key, and the engine stop detector detects the stopping of the engine, and wherein the engine start inhibitor is configured so as to inhibit starting of the engine after the time count of the timer reaches a predetermined time interval.

7. The theft prevention apparatus of claim 2, further comprising an alert indicator for alerting an operator of the personal watercraft when the main switch ON-state detector detects the main switch being in the ON-state, the key detector detects no operative insertion of the key, and the engine stop detector detects the stop of the engine.

8. The theft prevention apparatus of claim 2, wherein the engine start inhibitor cancels a state in which at least the engine is inhibited from starting, by turning the main switch back into an ON-state after turning the main switch into an OFF-state.

9. A theft prevention apparatus of a personal watercraft equipped with a main switch for opening/closing a main power-supply circuit including a starting circuit of an engine, comprising:

a main switch ON-state detector configured to detect that the main switch is in an ON-state;

an operating device configured to enable the main switch to be actuated;

an operating device detector configured to detect that the operating device is operatively coupled to an operating device receptor of the watercraft;

an engine stop detector configured to detect a stopping of the engine; and an engine start inhibitor configured to inhibit the engine from starting, provided that the main switch is detected in the ON-state by the main switch ON-state detector, the operating device and the operating device receptor are not detected to be operatively coupled by the operating device detector, and the stopping of the engine is detected by the engine stop detector;

wherein the operating device is an IC transmitter configured to store information related to an operator of the personal watercraft and capable of performing a radio-transmission of the information, and the operating device receptor is an IC receiver that is attached to a body of the personal watercraft and is configured to perform a radio-reception of the information transmitted from the IC transmitter;

wherein the main switch ON-state detector, operating device detector, engine stop detector, and engine start inhibitor are at least partially included within an electronic control unit that is connected with the IC receiver through a signal line, and that is also configured to give an instruction to the main switch to open/close the main power-supply circuit; and wherein the engine start inhibitor is configured to inhibit the engine from starting provided that the main switch is in the ON-state as detected by the main switch ON-state detector, no connection is detected to exist between the operating device and the main switch by the operating device detector, and the stopping of the engine is detected by the engine stop detector.

10. A theft prevention apparatus of a personal watercraft equipped with a main switch for opening/closing a main power-supply circuit including a starting circuit of an engine, comprising:

a main switch ON-state detector configured to detect that the main switch is in an ON-state;

an operating device configured to enable the main switch to be actuated;

an operating device detector configured to detect that the operating device is operatively coupled to an operating device receptor of the watercraft;

an engine stop detector configured to detect a stopping of the engine; and an engine start inhibitor configured to inhibit the engine from starting, provided that the main switch is detected in the ON-state by the main switch ON-state detector, the operating device and the operating device receptor are not detected to be operatively coupled by the operating device detector, and the stopping of the engine is detected by the engine stop detector, wherein the main switch is a key-operable main switch, the operating device receptor is a key-receiving portion of the key-operable main switch, and the operating device is a key for mechanically opening/closing the main power-supply circuit via the main switch; and wherein the engine start inhibitor cancels a state in which at least the engine is inhibited from starting, by turning the main switch back into the ON-state after turning the main switch into an OFF-state.

* * * * *